United States Patent [19]

Yang

[11] Patent Number: 4,720,082

[45] Date of Patent: Jan. 19, 1988

[54] GUIDE ROD DRIVE METHOD AND STRUCTURE USING SLIDABLE DRIVE SCREW NUT SET FOR GENERATING DRIVE FEEDING DEPENDENT ON THE SPEED CHANGE OF THE LOAD

[76] Inventor: Tai-Her Yang, 5-1 Taipin St., Si-Hu Town, Dzan-Hwa, Taiwan, Taiwan

[21] Appl. No.: 817,246

[22] Filed: Jan. 8, 1986

[51] Int. Cl.[4] ..... B66F 3/00

[52] U.S. Cl. ..... 254/126; 254/122

[58] Field of Search ..... 254/1, 122, 126

[56] References Cited

U.S. PATENT DOCUMENTS

| | | | |
|---|---|---|---|
| 1,545,223 | 7/1925 | Westrate | 254/126 |
| 2,492,853 | 12/1949 | Flynn | 254/126 |
| 2,920,871 | 1/1960 | Kolodin | 254/126 |
| 4,509,724 | 4/1985 | Okada | 254/126 |
| 4,583,713 | 4/1986 | Fukura et al. | 254/126 |

*Primary Examiner*—Robert P. Olszewski
*Assistant Examiner*—Judy J. Hartman
*Attorney, Agent, or Firm*—Leonard Bloom

[57] ABSTRACT

A drive rod apparatus and method generates a drive feed which is dependent on the speed change of the load. The apparatus and method, which is preferably embodied in a lifting jack, includes a slidable drive screw and nut set.

6 Claims, 20 Drawing Figures

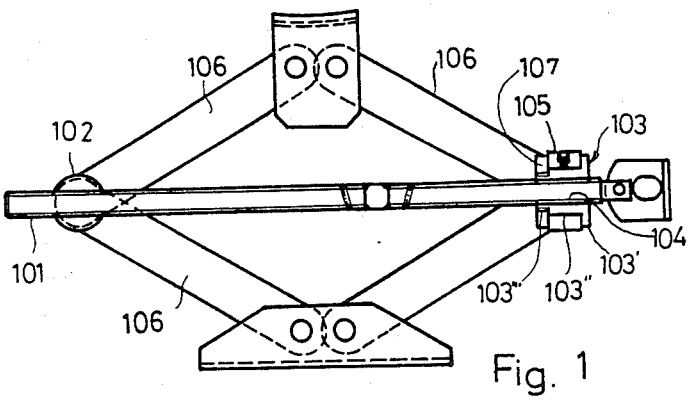
Fig. 1
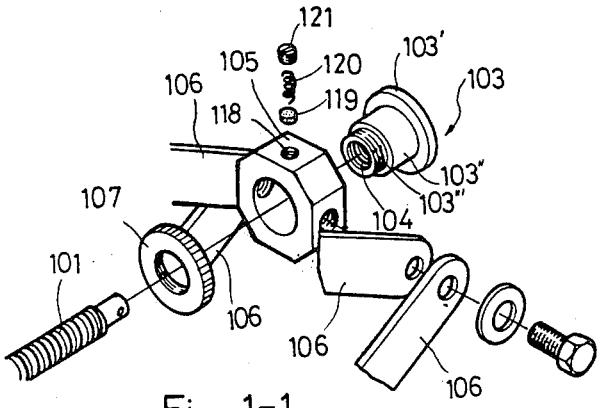
Fig. 1-1
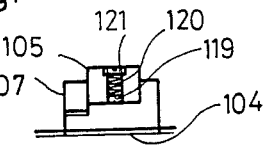
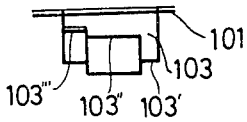
Fig. 1-2

GUIDE ROD DRIVE METHOD AND STRUCTURE USING SLIDABLE DRIVE SCREW NUT SET FOR GENERATING DRIVE FEEDING DEPENDENT ON THE SPEED CHANGE OF THE LOAD

BACKGROUND OF THE INVENTION

This invention is a design which can let guide rod drive structure change automatically the drive speed dependent on the load weight for reaching the function of time saving and force saving.

SUMMARY OF THE INVENTION

This is a guide rod drive method and structure using slidable drive screw nut set for generating the drive feeding dependent on the speed change of the load. Its feature lies in that a couple of positive (forward drive linkage) and reverse (rearward drive linkage) screw nuts are located respectively on two sets of the drive elements (forward and rearward support arms) and coupled with the screw rod (drive rod) having positive (a forward portion being threaded in a first direction) and reverse (a rearward portion being threaded in a second opposite direction) screw teeth with both sets of threads having the same pitches or with not same pitches at its two sides, in which one of screw nut sets has the feature of sliding movement generated dependent on increase of load, so that its driving working table or sliding block or vise moved jaw or extension & contraction jaw can make the function of quick feeding during light load and force saving slow feeding during heavy load due to slide of sliding screw nut. As shown in enclosure 1, the traditional extension & contraction type jack uses 4 sets of arms (forward support arms and rearward support arms) to compose 4-link-rod, in which a hanging hook is installed on its upper part (second end) and a basic seat (stationary base) is installed on its lower side (first end) and screw nut & stop bearing set (forward drive linkage and rearward drive linkage) are respectively installed on its two sides (the intermediate portions of forward and rearward support arms, respectively) for screwing screw rod. It uses screw rod drive to change the position of screw nut and further to change the distance between horizontal connectors (intermediate portions) of 4-link-rod, so that the distance between hanging hook of upper connector of 4-link-rod and basic seat of lower connector of 4-link-rod is also changed. Thus the upward or downward movement is reached. We can find that such structure has cheaper cost and simple structure, but it needs more time to be operated. This invention is an improved design based on above-said struture. It uses mainly a double screw rod and two sets of screw nuts coupled with it, in which one set of screw nuts can slide dependent on increase of load, so that the aim of quick drive during no load and slow drive changed automatically during heavy load can be reached and the operating time can be shortened. The following description shows the method of this design.

BRIEF DESCRIPTION OF THE DRAWINGS

FIG. 1 is a view of the applicable example used in expansion & contraction type jack showing the drive means thereof in cross-section for the sake of clarity.

FIG. 1-1 is a dismounted view of the sliding screw nut.

FIG. 1-2 is a cross sectional view of FIG. 1-1, when assembled.

FIG. 1-3 is a view of the applicable example of sliding screw nut with stop bearing.

FIG. 1-4 is a sectional view of FIG. 1-3.

FIG. 2 is a view of the applicable example of sliding screw nut with precompressed spring.

FIG. 2-1 is a sectional view of FIG. 2.

FIG. is a view of the applicable example of cup screw nut pushed by precompressed spring.

Figures 1, 2, 3:
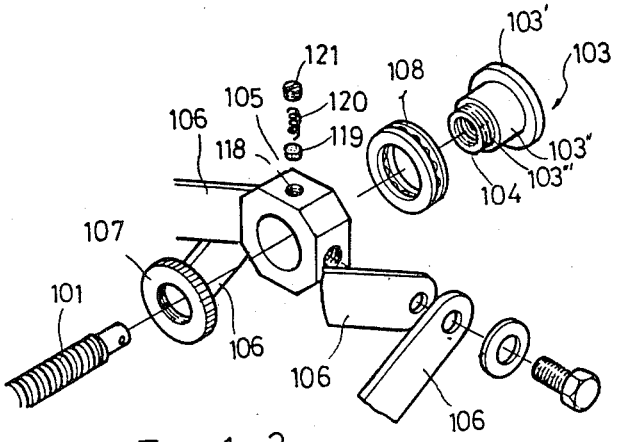

FIG. 2-3 is a view of the applicable example of sliding screw nut with additional precompressed spring.

Figures 1, 2, 3, 4:
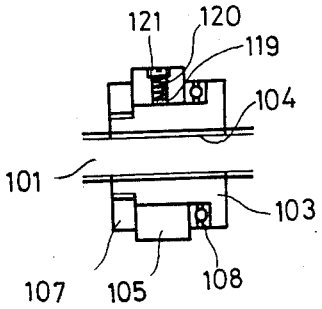

FIG. 2-4 is a sectional view of FIG. 2-3.

FIG. 2-5 a view of the applicable example of sliding nut with stepped section.

FIG. 3 is a view of the applicable example of the elastic cylindric outer cover.

FIG. 3-1 is a front sectional view of FIG. 3.

FIG. 3-2 side sectional view of FIG. 3.

FIG. 3-3 is a view of the applicable example of FIG. 3 with deformative limiting pin.

FIG. 4 is a view of the applicable example of the stop bearing, installed between guide rod shaking head and sliding screw nut.

Figure 2:
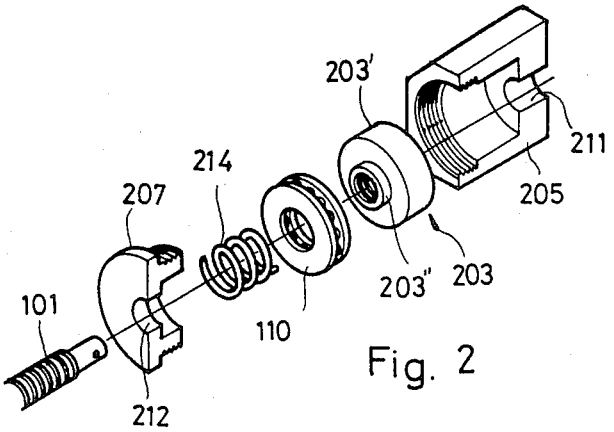
Figures 1, 2:
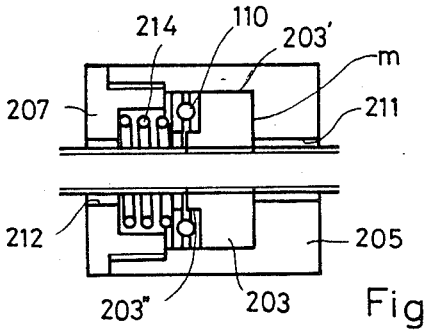
Figure 2:
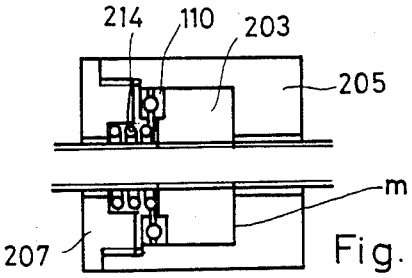
Figures 2, 3:
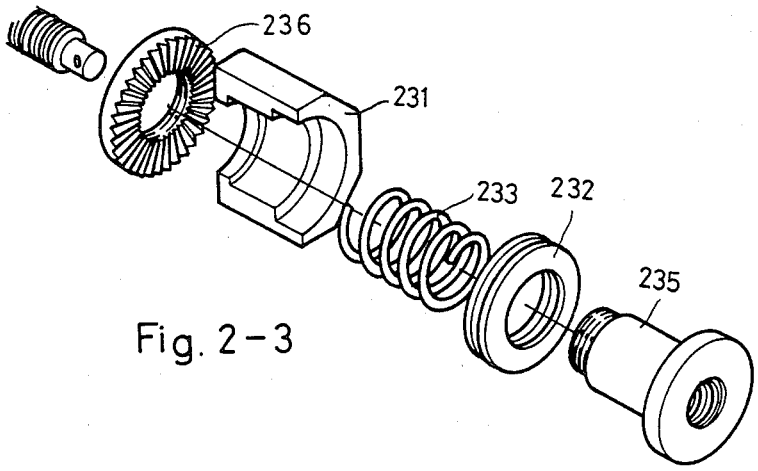
Figures 2, 3, 4:
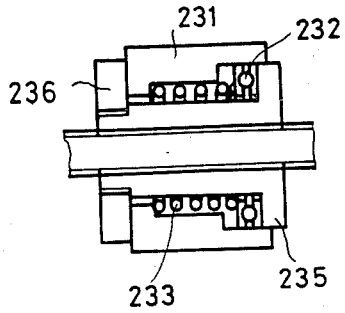
Figures 2, 3, 4, 5:
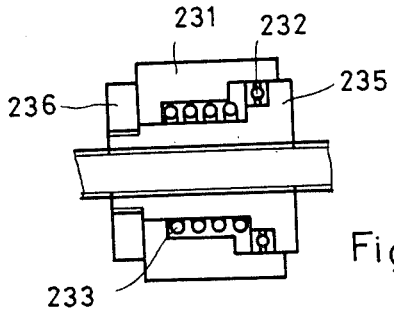
Figure 3:
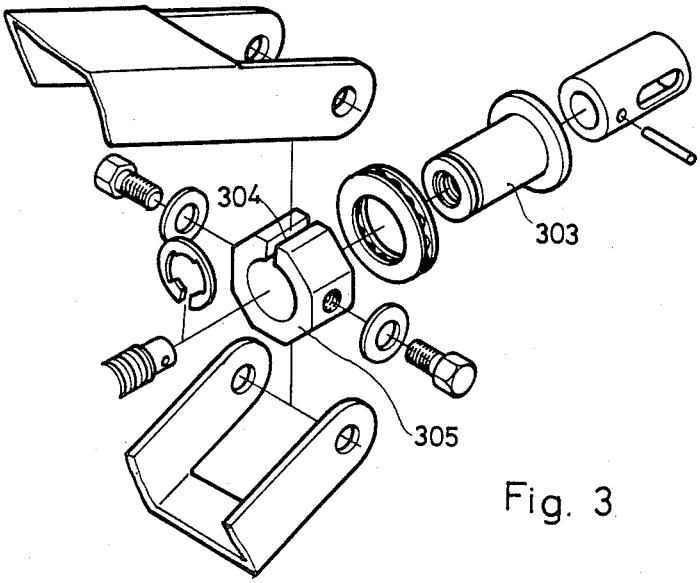
Figures 1, 3:
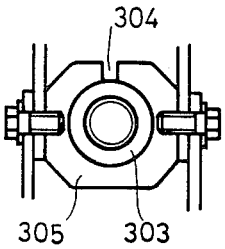
Figures 2, 3:
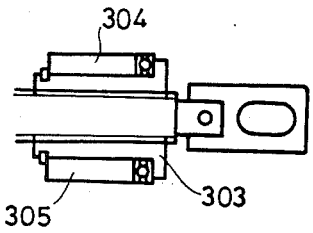
Figure 3:
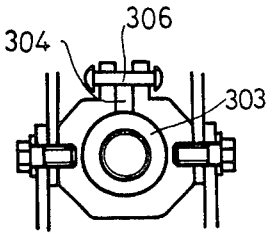
Figure 4:
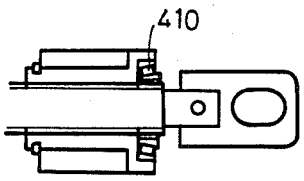
Figure 5:
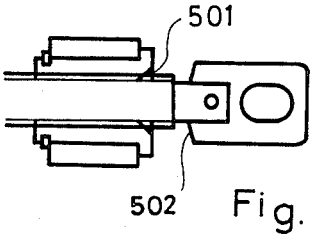

FIG. 5 is a view of the applicable of the slopy hole and slopy face used for reducing friction force and installed between guide shaking head and sliding screw nut.

Figure 6:
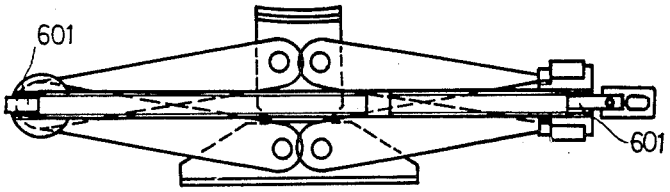

FIG. 6 is a view of the applicable example of the extension & contraction type jack, in which the section having smaller diameter and used for reducing friction force is installed at two ends of its guide rod.

Figure 7:
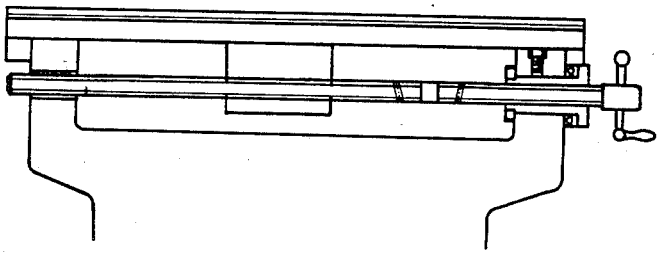

FIG. 7 is a view of the drive example used in the machine working table.

Figure 8:
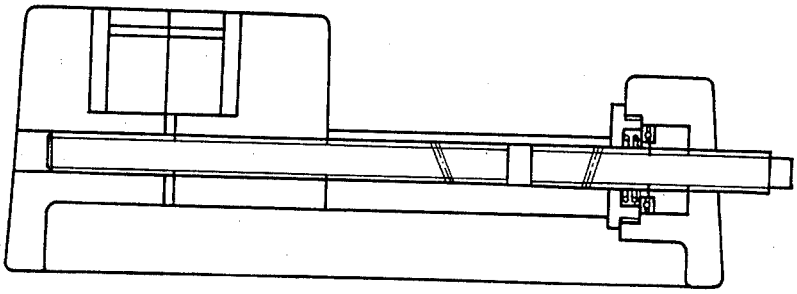

FIG. 8 is a view of the drive example used in the vise sliding block.

DETAILED DESCRIPTION OF THE INVENTION

Many machine structures are driven by the traditional guide rod, for example, the working table moves jowl, sliding block or vise or drive guide rod of extension & contraction type jack are applicated in the large range. But it can not cover the requirement of a changeable drive speed proportion, because the screw pitches are unchangeable. This design uses a screw rod with double way screw thread and two sets of double way screw nut installed respectively on the structure of the relative movement. Its main feature lies in that one set of the screw nut is fixing screw nut and another set is the slidable screw nut. When there is no load or only light load, the friction between the screw rod and the sliding screw nut is smaller than which between the sliding screw nut and the outer cover. At this moment, the slidable screw nut stops and the screw rod generates quick feeding effected by two sets of double screw nuts. When the sliding condition or slidable screw nut becomes that the screw rod shaft direction pressure generated due to load increment, the sliding movement is generated between the sliding screw nut and the outer cover, because the friction force between the screw rod and the sliding screw nut is larger than which between slidable screw nut and its coupled outer cover. Thus the force-saved function of the feeding is generated only by the fixing screw rod. The following example represents a design of the screw jack.

As shown in FIG. 1, this design has the structure of the traditional extension & contraction jack, such as the support arm, hanging hook and basic seat pin . . . etc, i.e. 4 sets of the support arm sets connect movably with hanging hook located on the upper part, basic seat located on the bottom part and screw nut located on a horizontal side. But another joint for composing 4-link-rod replaced by another set of the reverse screw. A friction resistance between reverse nut (drive sleeve) and outer cover (linkage block) used for linking support arm set is larger than which between the screw rod during unloaded drive and inner teeth of the screw nut, but smaller than which between screw rod and the inner teeth of the screw nut during the heavy load of the jack. Therefore, the screw nuts on two sides and double way screw rod generate a function during the light load to make quick feeding, and during the heavy load, an idle running between the reverse screw nut and the outer cover let the drive feeding is generated only by the screw nut on the another side as the traditional one.

In FIGS. 1, 1-1 and 1-2, two sides of the double way screw rod 101 are coupled respectively between a positive screw nut 102 and a reverse screw nut 103. One of two sets of the screw nuts shows the stepped cylindric shape. The diameter of its (outer cover) outer side section 103' (rearward outer cover) is the largest and which of its middle side section 103" (middle portion) is second largest one (defining a first shoulder therebetween) and which of its end section (forward portion) having the outer teeth (external annular threads) is the smallest one (defining a second shoulder therebetween). A screw thread 104 (internal threads) is installed in this screw nut for coupling the double way screw rod. It is located in the middle of the outer cover 105 with its inner hole and length corresponding to the diameter of the middle section 103" of the screw nut. The fixing pin rod screw hole is installed on two sides of the outer cover 105 for linking the support arm set 106; A screw hole 118 is installed on its side face for putting the adjusting block 119 (pressure pad), precompressed spring 120 (resilient screw spring) and adjusting screw 121 (set screw). Furthermore, a fixing screw nut collar 107 is used for screwing and fixing the outer teeth of the end section of the screw nut. When driven with no load, because the friction force between screw nut and the outer cover is larger than which between the guide rod and the inner teeth of the screw nut, fixing screw nut, sliding screw nut and the double way screw teeth generate the feeding. When the friction force between the screw teeth and the inner teeth of the screw nut increases to larger than which between the screw nut and the outer cover due to load increment, the outer cover and the screw nut generate the sliding movement. The feeding function is generated only by one side fixing screw nut, so that the aim of the force saving is reached.

FIGS. 1-3 and 1-4 are the structural example of the slidable reverse screw nut and the outer cover as shown in FIG. 1, in which in order to let the friction force between the outer cover and the sliding screw nut can make the obvious change due to load increment, a stop bearing 108 can be installed between the outer cover 105 and the coupling face of the stepped section 103' of the sliding nut with largest diameter, it uses the friction force between the middle hole of the inner cover and the middle section 103" or the sliding screw nut larger than which between the screw rod and the inner teeth of sliding screw nut to let sliding screw nut stop and to let the jack make quick feeding. When the load increases, the shaft direction pressure forced by the screw rod also increases, so that the friction force between the screw rod and the inner teeth of sliding screw nut increases. At this moment, the friction between the inner hole of the outer cover and the middle section of sliding screw nut is not changed. Because it installs the stop bearing, the increment of the friction force between the side face of the outer cover and the inner side of its coupled sliding screw nut section with largest diameter becomes smaller. When the friction force between the screw rod and the inner teeth increases, the sliding screw nut generates sliding movement, so that the feeding is generated only by the single side screw nut and it can reaches the aim of the force saving.

In the above-examples, the installed direction of the section 103' of sliding screw nut with larger diameter and the section 103" with smaller diameter and with screw teeth and screw nut can be changed reversely. At this moment, its function is unchanged. Furthermore, in the above-said applicable example, in order to let the friction force between inner cover and sliding screw nut during the idle running larger than which between the guide rod and the inner teeth sliding screw nut can be further reached using the structure as shown in FIGS. 2 and 2-1. In the structure as shown in FIGS. 2 and 2-1, the sliding screw nut shows double section stepped shape. The section 203' with larger diameter is coupled with the inner hole of an outer cover 205 and the section 203" with smaller diameter is used for coupling with inner side of the stop bearing; The outer cover 205 shows cup structure. The pin rod and screw hole for coupling with support arm are installed on two sides of the cup shape and have hole 211 with diameter larger than which of the screw rod for pentrating the screw rod. The screw teeth are installed in the inside of the cup shape for screwing a stepped cup screw nut 207. A pentrating hole 212 with its diameter larger than which of the screw rod is installed in the middle of this cup screw nut 207 and is used for pentrating screw rod through it. A spring 214 is located in the cup hole and its inner diameter is larger than which of the screw rod. Another side of the spring is located on the outer side of the stop bearing. A pitch is located between the cup opening of the cup screw nut 207 and the outer side of the stop bearing. It will become smaller and then disappear, when it is compressed. The function of this structure lies in that the friction force between sliding screw nut 203 and outer cover generated by contact of the friction face and outer ring due to spring static pressure during the idle running of the jack is larger than which between the guide rod and the sliding screw nut teeth. During the heavy load, because the shaft direction compressed force is generated between outer cover sliding screw nut, the spring is compressed. At this moment, a pitch is formed between outer cover or sliding screw nut and friction face to eliminate the force and to let sliding screw nut generate sliding movement due to increase of the friction force between the guide rod and the inner teeth, so that the drive feeding is generated by the single side screw nut.

In the above-said structural example as shown in FIGS. 2 and 2-1, the forced side of the spring can be made in smaller diameter as shown in FIG. 2-2, in which its one side is compressed to cup screw nut 207 and its another side is compressed to a side of sliding screw nut. Its moved principle is same as which of the applicable example as shown in FIG. 2.

FIGS. 2-3 and 2-4 are another applicable examples of the structures shown in FIGS. 2 and 2-1. It uses mainly a set of outer cover 231 used for connecting the support arm to manufacture a multisectional ring holes. The stop bearing 232 is put in the outer section with larger hole diameter and the precompressed spring 233 is put in its middle section. The stop spring 233 is limited between the inner side of the stop bearing and inside of the inner hole of the outer cover 231; The stepped sliding screw nut is used for pentrating the stop bearing, precompressed spring and inner hole of the outer cover. The section with larger diameter on its outer side is used for compressing the stop bearing and the last section with screw threads on its inside is used for connecting a friction ring 236; The sloppy toothed shaped friction face coupled with the radial inside of the friction ring 236 and its opposite outer cover generates a friction using the compressure of the precompressed spring during the light load to let the quick feeding can be made in all two directions. During the heavy load, the toothed friction face separates, because the outer cover compresses the precompressed spring. At this time, the sliding screw nut generates idle running and makes a slow and force-saved drive;

FIG. 2–5 shows further that the middle section of the screw nut is made to a stepped shape for compressing the precompressed spring.

FIGS. 3, 3-1 and 3-2 are the applicable examples of the above-said sliding screw nut used further for extension & contraction type jack, in which it uses mainly an elastic cylindric outer cover which can tend toward outer dependent on the load pressure to replace the above-said cylinder. As shown in the drawing, a cutting cleft 304 is installed on the upper side of the elastic cylindric outer cover 305 and the support arm set is installed on two sides of the cutting cleft. During the light load, the elastic cylindric outer cover makes the screw nut and the guide rod to generate the relative displacement due to clamping or slidable screw nut 303 located in its inside caused by the original elastic force; During the heavy load, the elastic cylindric outer cover extends slightly toward outer to let sliding screw nut 303 rotate together with the guide rod, so that the screw nut on the fixing side generates the driving function and the aim of the force saving is reached; The stop bearing can be selected for installing between sliding screw nut and outer cover, or two parts slide each other directly. Due to safety, the limiting pin rod 306 as shown in FIG. 3-3 can be installed additionally in the above-said elastic cylindric outer cover. This limiting pin rod has two larger ends which are locked freely or riveted in the transverse hole of the convex part of clamping cleft in the elastic cylinder for limiting its stretch opened deformative quantity with no obstruction of the deformation in the preset range.

FIG. 4 shows the sliding screw nut and guide rod shaking head located at the lowest position. At this moment, a stop bearing 410 can be further installed between guide rod and screw nut using the friction force between them to avoid that the inside of shaking handle and sliding screw nut are locked during the contraction of the jack; or as shown in FIG. 5, the outer side of the screw hole of sliding screw nut is made in a suitable opening shape 501 or guide rod shaking head is made with a slope 502 to avoid the larger friction force between both parts; When the extension & contraction type jack is located at the lowest position, it has lowest drive efficiency, because the inner angle of the support arms are near to zero. In order to reduce the friction force between guide rod and sliding screw nut, two ends of guide rod can be made to a section 601 with diameter smaller than which of the root part of guide rod screw teeth, i.e. when it locates at the lowest position, the coupling section of the inner teeth of the screw nuts on two sides coupled with two ends of the screw rod includes the section with smaller diameter in order to reduce the friction force of this section as shown in FIG. 6.

Furthermore, the speed changing drive equipment dependent on the load sliding screw nut and double way guide rod can be also used in the machine working table driven by the guide rod or sliding block or vise or another applications as shown in FIG. 7 and 8.

I claim:

1. In a loading-lifting device, the combination of a drive rod including a forward portion being threaded in a first direction, a rearward portion being threaded in a second, opposite direction, and an intermediate, unthreaded portion therebetween, drive means for rotatably moving the drive rod in first and second opposite directions, a driven member for supporting the load thereon, the driven member being driven in first and second opposite directions in response to the rotational movement of the drive rod for thereby lifting the load on the driven member, said driven member being connected to the respective forward and rearward portions of the drive rod by a pivotable linkage means, the linkage means including a drive sleeve threadably carried on the rearward portion of the drive rod, the drive sleeve having an outer periphery, the linkage means further including a linkage block in which at least partly disposed therein, the driven load supported by the member exerting a force on the linkage block through the linkage means, a positive screw nut structure on the forward portion of the drive rod between the drive rod and the linkage means, an adjustable pressure means carried by the linkage block and contacting the periphery of the drive sleeve for applying a pressure thereon, wherein when the pressure on the drive sleeve exceeds the force on the linkage block, the drive sleeve is maintained in a substantially stationary position relative to the rotary movement of the drive rod, and further wherein when the force on the linkage block exceeds the pressure on the drive sleeve, the drive sleeve rotates substantially in unison with the drive rod.

2. In a jack for lifting an article, said jack having a drive rod including a forward portion being threaded in a first direction, a rearward portion being threaded in a second, opposite direction and an intermediate unthreaded portion therebetween, drive means for rotatably moving the drive rod in first and second opposite directions, a stationary base, a saddle having the article disposed thereon, said saddle being driven in first and second opposite directions in response to the rotational movement of the drive rod, forward drive linkage being threadably carried on the forward portion of the drive rod, rearward drive linkage including a drive sleeve threadably carried on the rearward portion of the drive rod, a linkage block having the drive sleeve being at least partly disposed therein, forward support arms having a first end being pivotably secured to the stationary base, a second end being pivotably ssecured to the saddle and an intermediate portion being pivotably secured to the forward drive linkage, wherein the first and second ends of the forward support arms pivot thereabout in opposite saddle raising and lowering directions and rearward support arms having a first end being pivotably secured to the stationary base, a second end being pivotably secured to the saddle and an intermediate portion being pivotably secured to the rearward drive linkage, wherein the first and second ends of the rearward support arms pivot thereabout in opposite saddle raising and lowering directions, such that the article on the saddle applies a drive pressure on the rearward drive linkage, wherein the improvement comprises:

a pressure means carried by the rearward linkage block contacting the drive sleeve for applying a tension pressure thereon, wherein when the tension pressure exceeds the drive pressure, the drive sleeve is maintained in a substantially stationary position relative to the movement of the drive rod and, further wherein when the drive pressure exceeds the tension pressure, the drive sleeve rotates substantially concomitant with the drive rod.

3. The jack of claim 2, wherein the rearward linkage block has an aperture formed therethrough and wherein the pressure means is comprised of a set screw being adjustably secured in the aperture of the rearward linkage block;

a pressure pad being positioned in the aperture contacting the drive sleeve wherein the tension pressure is applied thereon;

a resilient screw spring being positioned in the aperture between the set screw and the pressure pad, said spring having a first end contacting the pressure pad and a second end contacting the set such that adjustment of the set screw increases and decreases the tension pressure.

4. The jack of claim 3, wherein the drive sleeve includes a substantially rearward outer cover, a cylindrical middle portion integrally formed with the outer cover forwardly thereof, said middle portion being of reduce diameter relative to the outer cover, defining a first shoulder therebetween and a forward portion having external annular threads formed thereon, being integrally formed with the middle portion, forwardly thereof, said forward portion being of reduced diameter relative to the middle portion defining a second shoulder therebetween;

a collar having an annular internal threads formed thereon to threadably engage the external annular threads of the forward portion of the drive sleeve;

wherein when the drive sleeve is disposed in the rearward linkage block, the first shoulder annularly contacts the linkage block and the forward threaded portion extends forwardly from said linkage block, the collar being threadably received on said forward portion, annularly contacting the second shoulder and the linkage block, such that the pressure pad contacts the middle portion of the drive sleeve.

5. A jack for lifting an article, said jack comprised of:

a drive rod including a forward portion being threaded in a first direction, a rearward portion being threaded in a second, opposite direction and an intermediate unthreaded portion therebetween;

drive means for rotatably moving the drive rod in first and second opposite directions:

a stationary base;

a saddle having the article disposed thereon, said saddle being driven in first and second opposite directions in response to the rotational movement of the drive rod;

forward drive linkage being threadably carried on the forward portion of the drive rod;

rearward drive linkage, including a drive sleeve threadably carried on the rearward portion of the drive rod and a linkage block having the drive sleeve being at least partly disposed therein;

forward support arms having a first end being pivotably secured to the stationary base, a second end being pivotably secured to the saddle and an intermediate portion being pivotably secured to the forward drive linkage, wherein the first and second ends of the forward support arms pivot thereabout in opposite saddle raising and lowering directions;

rearward support arms having a first end being pivotably secured to the stationary base, a second end being pivotably secured to the saddle and an intermediate portion being pivotably secured to the rearward drive linkage, wherein the first and second ends of the rearward support arms pivot thereabout in opposite saddle raising and lowering directions, such that the article on the saddle applies a drive pressure on the rearward drive linkage;

a pressure means carried by the rearward linkage block contacting the drive sleeve for applying a tension pressure thereon, wherein when the tension pressure exceeds the drive pressure, the drive sleeve is maintained in a substantially stationary position relative to the movement of the drive rod and, further wherein when the drive pressure exceeds the tension pressure, the drive sleeve rotates substantially concomitant with the drive rod.

6. A jack for lifting an article, said jack comprised of:

a drive rod including a forward portion being threaded in a first direction, a rearward portion being threaded in a second, opposite direction and an intermediate unthreaded portion therebetween;

drive means for rotatably moving the drive rod in first and second opposite directions:

a stationary base;

a saddle having the article disposed thereon, said saddle being driven in first and second opposite directions in response to the rotational movement of the drive rod;

forward drive linkage being threadably carried o the forward portion of the drive rod;

rearward drive linkage, including a drive sleeve threadably carried on the rearward portion of the drive rod and a linkage block having an aperture formed therethrough and further having the drive sleeve being at least partly disposed therein;

said drive sleeve including a substantially rearward outer cover, a cylindrical middle portion integrally formed with the outer cover forwardly thereof, said middle portion being of reduced diameter relative to the outer cover, defining a first shoulder therebetween and a forward portion having external annular threads formed thereon, being integrally formed with the middle portion, forwardly thereof, said forward portion being of reduced diameter relative to the middle portion defining a second shoulder therebetween;

a collar having an annular internal formed thereon to threadably engage the external annular threads of the forward portion of the drive sleeve;

wherein when the drive sleeve is disposed in the rearward linkage block, the first shoulder annularly contacts the linkage block and the forward threaded portion extends forwardly from said linkage block, the collar being threadably received on said forward portion, annularly contacting the second shoulder and the linkage block;

forward support arms having a first end being pivotably secured to the stationary base, a second end being pivotably secured to the saddle and an intermediate portion being pivotably secured to the forward drive linkage, wherein the first and second ends of the forward support arms pivot thereabout in opposite saddle raising and lowering directions;

rearward support arms having a first end being pivotably secured to the stationary base, a second end being pivotably secured to the saddle and an intermediate portion being pivotably secured to the rearward drive linkage, wherein the first and second ends of the rearward support arms pivot thereabout in opposite saddle raising and lowering directions, such that the article on the saddle applies a drive pressure on the rearward drive linkage;

a pressure means for applying a tension pressure on the drive sleeve, said pressure means including a set screw being adjustably secured in the aperture of the rearward linkage block, a pressure pad being positioned in the aperture contacting the middle portion of the drive sleeve wherein the tension pressure is applied thereon, and a resilient screw spring being positioned in the aperture between the set screw and the pressure pad, said spring having a first end contacting the pressure pad and a second end contacting the set screw such that adjustment of the set screw increases and decreases the tension pressure, wherein when the tension pressure exceeds the drive pressure, the drive sleeve is maintained in a substantially stationary position relative to the movement of the drive rod and, further wherein when the drive pressure exceeds the tension pressure, the drive sleeve rotates substantially concomitant with the drive rod.

* * * * *